US009663324B2

(12) United States Patent
Suzuki

(10) Patent No.: US 9,663,324 B2
(45) Date of Patent: May 30, 2017

(54) ELEVATOR SYSTEM WITH AN ELEVATOR GROUP-CONTROL DEVICE FOR CONTROLLING A PLURALITY OF CARS

(75) Inventor: Naohiko Suzuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 481 days.

(21) Appl. No.: 14/354,815

(22) PCT Filed: Nov. 28, 2011

(86) PCT No.: PCT/JP2011/006598

§ 371 (c)(1),
(2), (4) Date: Apr. 28, 2014

(87) PCT Pub. No.: WO2013/080242

PCT Pub. Date: Jun. 6, 2013

(65) Prior Publication Data

US 2014/0291077 A1 Oct. 2, 2014

(51) Int. Cl.

| | |
|---|---|
| ***B66B 1/18*** | (2006.01) |
| ***B66B 1/34*** | (2006.01) |
| ***B66B 1/24*** | (2006.01) |

(52) U.S. Cl.

CPC ..... *B66B 1/34* (2013.01); *B66B 1/2433* (2013.01); *B66B 2201/103* (2013.01); *B66B 2201/224* (2013.01)

(58) Field of Classification Search

CPC ... B66B 1/34; B66B 1/2433; B66B 2201/103; B66B 2201/223

(Continued)

(56) References Cited

U.S. PATENT DOCUMENTS 3,625,311 A * 12/1971 Nowak ..... B66B 1/2458 187/380
4,582,173 A * 4/1986 Schroder ..... B66B 1/2416 187/387

(Continued)

FOREIGN PATENT DOCUMENTS

| | | |
|---|---|---|
| JP | 04-094384 | 3/1992 |
| JP | 08-259126 | 10/1996 |

(Continued)

OTHER PUBLICATIONS

International Search Report issued Mar. 6, 2012, in PCT/JP11/006598, filed Nov. 28, 2011.

*Primary Examiner* — Anthony Salata
(74) *Attorney, Agent, or Firm* — Oblon, McClelland, Maier & Neustadt, L.L.P.

(57) ABSTRACT

In an elevator system in which a plurality of cars are operated in a coupled or independent manner in a single hoistway, an elevator group-control device includes a front-car car-call detection unit detecting a car call of a front car with respect to its traveling direction out of the plurality of cars or for detecting a floor and a car that are assigned a destination floor of a registered destination floor call; and a rear-car assignment-candidate exclusion unit excluding, from assignment candidate cars, a rear car in the same hoistway as the front car assigned the car call when a landing call for the same direction as the traveling direction is registered at a floor registered by the car call detected by the front-car car-call detection unit.

3 Claims, 7 Drawing Sheets

(58) Field of Classification Search
USPC ..... 187/247, 249, 277, 380–388, 902
See application file for complete search history.

(56) References Cited

U.S. PATENT DOCUMENTS 4,632,224 A * 12/1986 Nowak ..... B66B 1/2458 187/387
4,836,336 A * 6/1989 Schroder ..... B66B 1/2458 187/384
5,419,414 A * 5/1995 Sakita ..... B66B 1/2433 187/247
5,844,179 A * 12/1998 Walker ..... B66B 1/2416 187/382
5,861,587 A * 1/1999 Powell ..... B66B 1/2416 187/249
6,237,721 B1 * 5/2001 Siikonen ..... B66B 1/2458 187/382
6,273,217 B1 * 8/2001 Hikita ..... B66B 1/18 187/382
7,784,588 B2 * 8/2010 SikShin ..... B66B 1/2433 187/249
8,739,936 B2 * 6/2014 Kostka ..... B66B 1/2433 187/249
2016/0145073 A1 * 5/2016 Sorsa ..... B66B 1/2433 187/247

FOREIGN PATENT DOCUMENTS

JP 09-323869 12/1997
JP 11-199144 7/1999
JP 2000-327237 11/2000
JP 2001-310876 11/2001
JP 2005-008422 1/2005
JP 2007-169012 7/2007
JP 2007-223765 9/2007

* cited by examiner

ELEVATOR SYSTEM WITH AN ELEVATOR GROUP-CONTROL DEVICE FOR CONTROLLING A PLURALITY OF CARS

TECHNICAL FIELD

The invention relates to an elevator group-control device for controlling a plurality of cars in a double-deck elevator system in which a plurality of cars are operated in a coupled manner in a single hoistway, or in a one-shaft multi-car system in which a plurality of cars are operated independently in a single hoistway.

BACKGROUND ART

In a conventional elevator group-control device for a double-deck elevator, for example, at an upward operation, when a same-direction assignment detection means detects that an up landing call of the 6th floor is assigned to an upper car and an other-car car-call presence/absence determining means determines registration of a car call of the 6th floor for a lower car, an assignment changing means changes the assignment of the up landing call of the 6th floor from the upper car to the lower car to deal with both calls by a single stop (for example, refer to Patent Document 1).

PRIOR ART DOCUMENT

Patent Document

Patent Document 1: Japanese Unexamined Patent Publication No. H08-259126

SUMMARY OF THE INVENTION

Problems to be solved by the Invention

In a conventional elevator group-control device for a double-deck elevator or a one-shaft multi-car elevator, by the change in assignment afterward, a landing call for and a car call of a lower car or an upper car are managed to be assigned to either one of the cars. However, in a system in which a destination floor call is registered by inputting a destination floor at a hall, an assigned car is informed to each user when a destination floor is inputted at a hall, and the assignment cannot be changed afterward. Therefore, there has been a problem that the conventional method cannot be adopted.

In addition, in a system in which a destination floor call is registered by inputting a destination floor at a hall, if a front car arrives in response to a car call and a landing call for the same floor and the same direction as the car call is assigned to a rear car in the same hoistway and if no means is provided for informing a user of whether the arriving car with the door opened is the front car or the rear car in the same hoistway, a case may occur in which a user who needs to board the rear car to which the landing call is originally assigned may erroneously board the car that has arrived at a car call destination in response to the car call. In general, in a system in which a destination floor call is registered by inputting a destination floor at a hall, a destination button is not installed in an elevator car or input of a destination car button in an elevator car cannot be registered in many cases, so that there has been a problem that only movement to a floor different from an intended destination floor may be possible or users may be trapped if a front car that users erroneously board stops for a last car call.

Means for Solving the Problems

An elevator group-control device according to the invention includes a front-car car-call detection means for detecting a car call of a front car with respect to its traveling direction out of the plurality of cars or for detecting a floor and a car that are assigned a destination floor of a registered destination floor call; and a rear-car assignment-candidate exclusion means for excluding, from assignment candidate cars, a rear car in the same hoistway as the front car assigned the car call when a landing call for the same direction as the traveling direction is registered at a floor registered by the car call detected by the front-car car-call detection means.

Effect Of The Invention

An elevator group-control device according to the invention includes a rear-car assignment-candidate exclusion means for excluding a rear car in the same hoistway from assignment candidate cars when a front car in the same hoistway is assigned a car call and a landing call for the same floor and the same direction as the car call is registered. This allows a passenger to be prevented from erroneously boarding a car different from a car that the passenger should board and further allows for eliminating installation of a unit such as a display for informing a passenger of whether a currently arriving car is the upper car or the lower car to help the passenger avoid erroneously boarding the car.

EMBODIMENT FOR CARRYING OUT THE INVENTION

Embodiment 1

Figure 1:
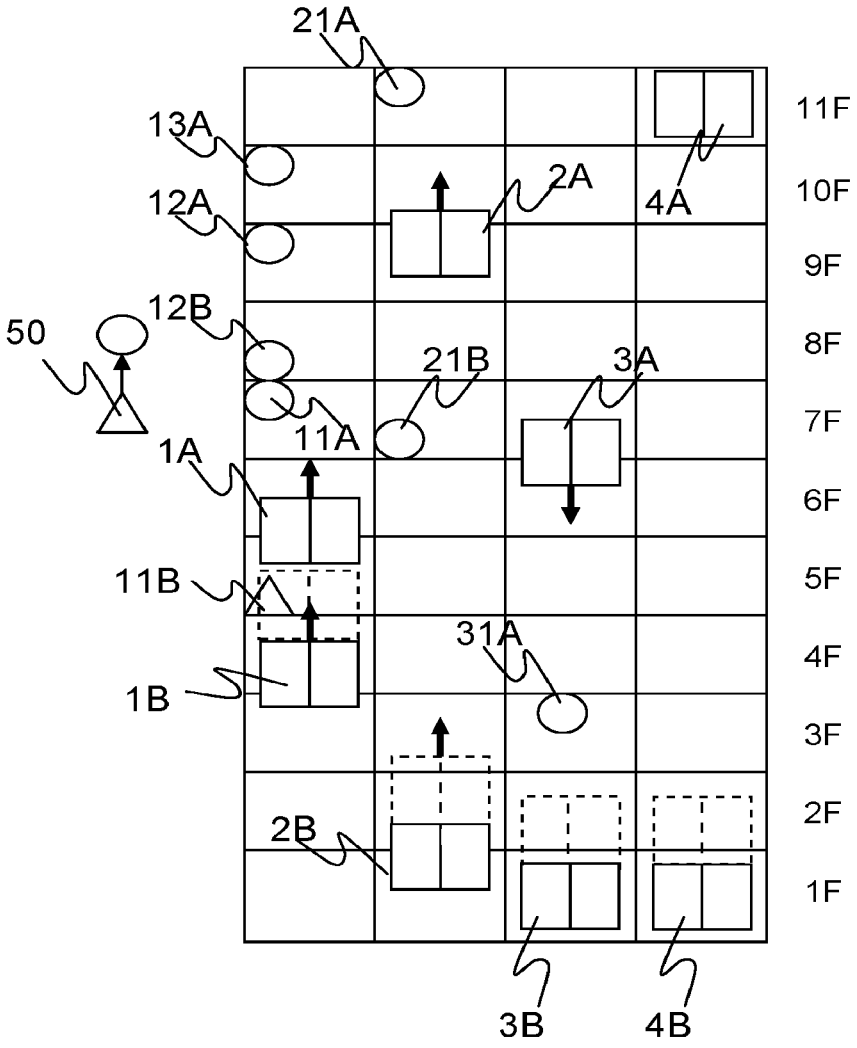
FIG. 1 is a diagram showing a call status of an elevator group-control device according to Embodiment 1 of the invention.

FIG. 1 is a diagram showing landing calls, car calls, and positions of cars, in an elevator group-control device according to Embodiment 1 of the invention. FIG. 1 shows a one-shaft multi-car elevator system in which a plurality of cars travel independently in the same hoistway. A pair of cars 1A and 1B, 2A and 2B, 3A and 3B, and 4A and 4B are operated in respective same hoistways. The upper car 1A travels upwardly and is stopping at the 7th floor in response to a car call 11A, at the 9th floor in response to a car call 12A, and at the 10th floor in response to a car call 13A. The lower car 1B travels upwardly and is stopping at the 5th floor in response to a landing call 11B and at the 8th floor in response to a car call 12B. The car 2A travels upwardly and is stopping at the 11th floor in response to a car call 21A, and the car 2B travels upwardly and is stopping at the 7th floor in response to a car call 21B. The car 3A travels downwardly and is stopping at the 3rd floor in response to a car call 31A.

Here, an operational flow will be explained assuming a case where a destination floor call 50 of the 7th floor for the 8th floor is newly registered. Using a front-car car-call detection means for detecting a car call of a front car with respect to its traveling direction or detecting a floor and a car that are assigned a destination floor of a registered destination floor call, the car 1A and the car call 11A for the 7th floor, the car 1A and the car call 12A for the 9th floor, the car 1A and the car call 13A for the 10th floor, and the car 2A and the car call 21A for the 11th floor are detected. Next, when a landing call for the same direction as the traveling direction is registered at a floor registered by the car calls detected by the front-car car-call detection means, by a rear-car assignment-candidate exclusion means that excludes, from assignment candidate cars, the rear car in the same hoistway as the front car that is assigned the car call, the front car 1A that is assigned the car call for the same direction and the same floor as the landing call of the 7th floor and the rear car 1B in the same hoistway are selected for the newly registered landing call of the 7th floor for the 8th floor, and the car 1B is excluded from the assignment candidate cars. The elevator group-control device selects an assignment car from other cars excluding the car 1B, dispatches the assignment car for the new destination floor call 50 of the 7th floor for the 8th floor, and displays the assigned car number in a liquid-crystal display part of an operational panel for registering a destination floor at a hall.

While the up car call 21B for the 7th floor assigns the same travel direction and floor as the new destination floor call for the 7th floor and is assigned to the lower car, i.e., not from a front car but from the rear car, the car 2B is not excluded from assignment candidate cars.

Figure 2:
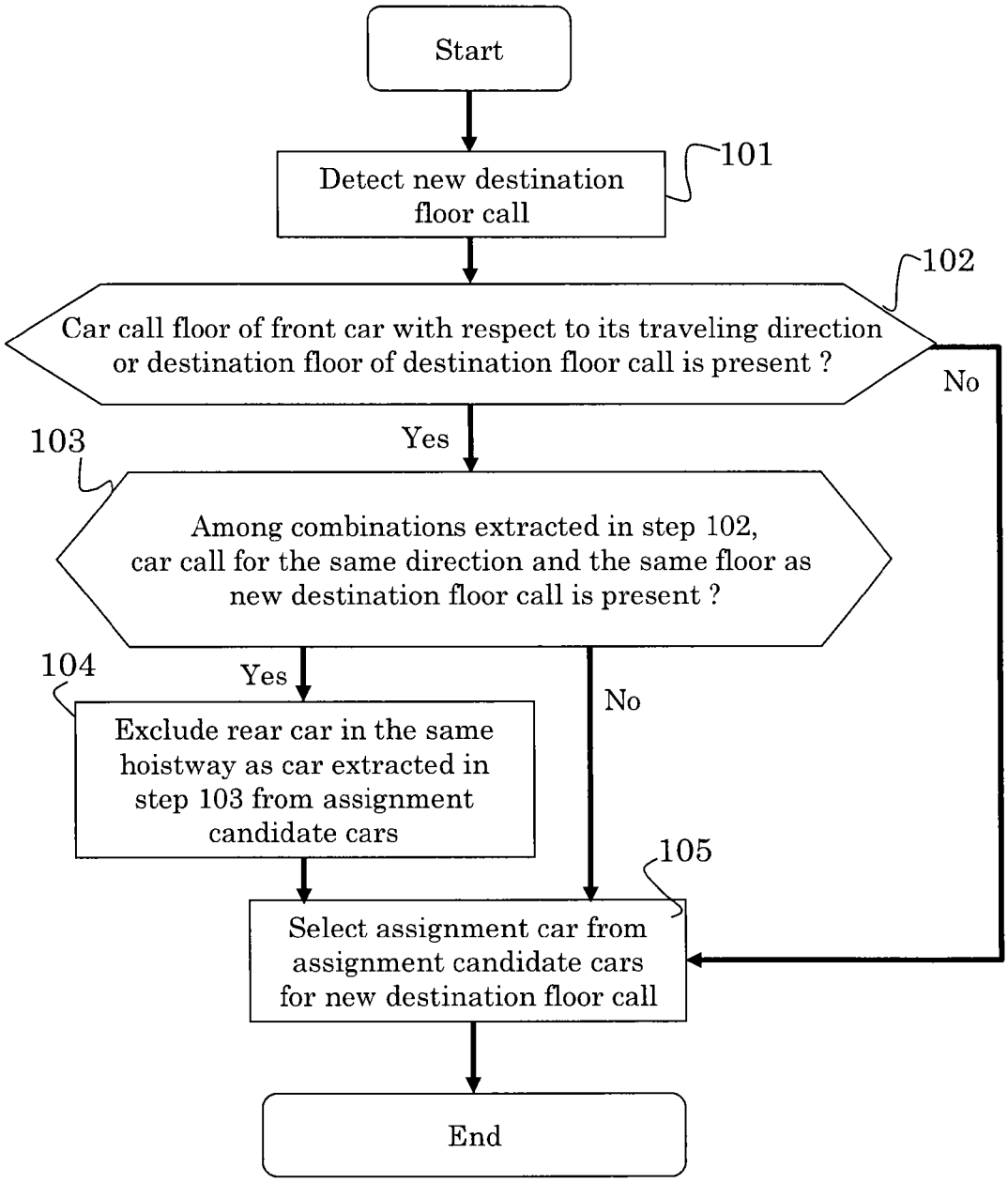
FIG. 2 is a flow chart showing an operational flow of the elevator group-control device according to Embodiment 1 of the invention.

Next, an assigned car selecting method for the elevator group-control device according to Embodiment 1 of the invention will be explained using the flow chart of FIG. 2. First, in Step 101, a new destination floor call is detected. Next, in Step 102, combinations of a car call floor of a front car with respect to its traveling direction and the car are extracted. In this step, an upper car and a lower car in the same hoistway are separately extracted. Next, among the combinations extracted in Step 102, it is determined in Step 103 whether or not there exists a car call that coincides with the new destination floor call in terms of the traveling direction and the floor. In Step 104, if it is determined in Step 103 that there exists an applicable car, a rear car in the same hoistway as the car is excluded from candidate cars to be assigned and Step 105 is performed. If it is determined in Step 103 that there exists no applicable car, Step 105 is performed. In Step 105, an appropriate assignment car is selected among assignment candidate cars so as to reduce the waiting time at each hall and the number of stops of each car.

Next, a system configuration of the invention will be described with reference to FIG. 7. A destination floor is inputted using a numerical keypad of each of hall operational panels 410A to 410C installed at a hall. The information on the inputted destination floor is sent to an elevator group-control device 420, and a car that satisfies the exclusive condition is excluded from the assignment candidates by a rear-car assignment-candidate exclusion means 421. An assignment car selection means 422 selects an appropriate assignment car among assignment candidate cars obtained from the rear-car assignment-candidate exclusion means 421 so as to reduce the waiting time at each hall and the number of stops of each car. Among the liquid crystal parts 411A to 411C, the liquid crystal part of the hall operational panel to which the destination floor is inputted, displays an assigned elevator name such as, for example, "A" and "C" on the basis of the selected assignment car. Among individual elevator control units 430A to 430D, the elevator group-control device 420 gives an instruction for the individual elevator control unit corresponding to the selected assignment car to operate the car from the floor where the landing call is inputted, to the registered destination floor.

It should be noted that, although the explanation has been made for an elevator group-control device for controlling a one-shaft multi-car elevator system in which a plurality of cars are operated independently in the same hoistway, the elevator group-control device may be for controlling a double-deck elevator system in which a plurality of cars are operated in a coupled manner.

The elevator group-control device thus configured eliminates arrival of the rear car in the same hoistway in response to a landing call for the same floor and the same direction as the front car after first arrival of the front car in response to a car call. This brings about an effect of preventing a passenger from erroneously boarding the car arriving in response to the car call and further brings about an effect of eliminating installation of a unit such as a display for informing a passenger of whether a currently arriving car is the upper car or the lower car to help a passenger avoid erroneously boarding the car.

Embodiment 2

Figure 3:
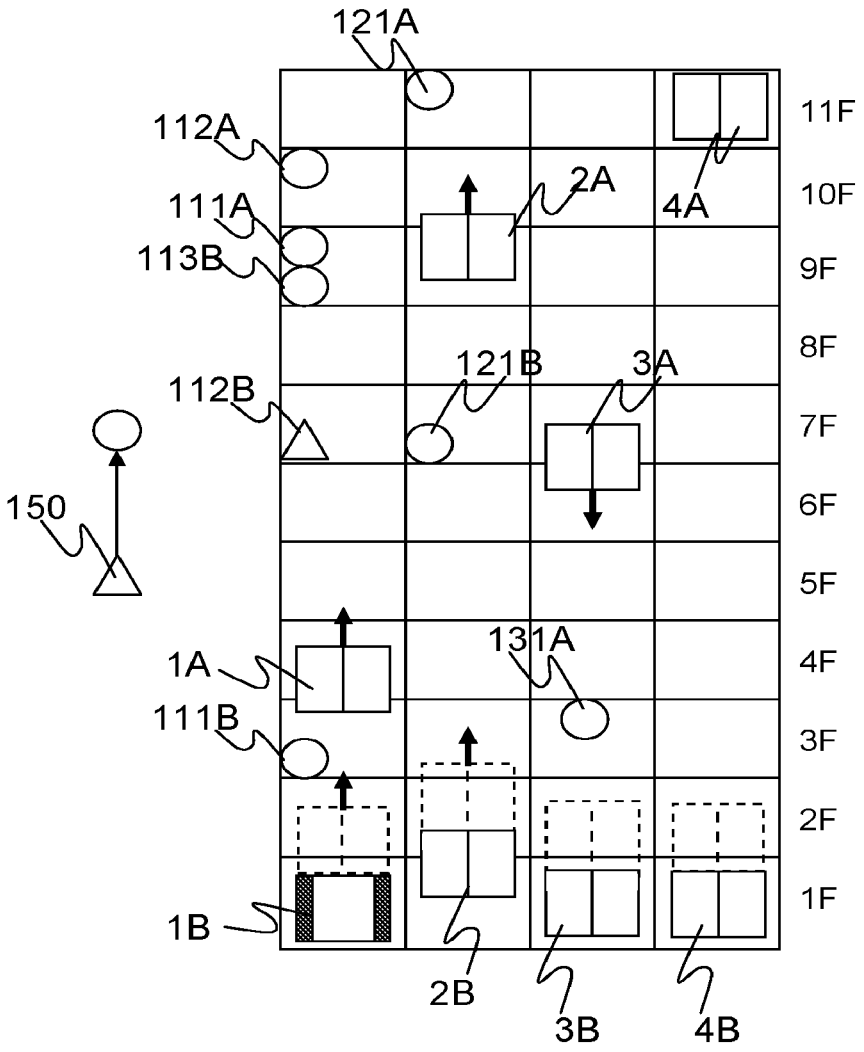
FIG. 3 is a diagram showing a call status of an elevator group-control device according to Embodiment 2 of the invention.

FIG. 3 is a diagram showing landing calls, car calls, and positions of cars registered by an elevator group-control device according to Embodiment 2 of the invention. FIG. 3 shows a one-shaft multi-car elevator system in which a plurality of cars are operated independently in the same hoistway. A pair of cars 1A and 1B, 2A and 2B, 3A and 3B, and 4A and 4B are operated in respective same hoistways. The upper car 1A travels upwardly and is stopping at the 9th floor in response to a car call 111A and at the 10th floor in response to a car call 112A. The lower car 1B, since it travels upwardly, is stopping at the 3rd floor in response to a car call 111B, at the 7th floor in response to an up landing call 112B, and at the 9th floor in response to a car call 113B. The car 2A travels upwardly and is stopping at the 11th floor in response to a car call 121A, and the car 2B travels upwardly and is stopping at the 7th floor in response to a car call 121B. The car 3A travels downwardly and is stopping at the 3rd floor in response to a car call 131A.

Here, an operational flow will be explained assuming a case where a destination floor call 150 of the 5th floor for the 7th floor is newly registered. Using a rear-car landing-call detection means for detecting a floor and a car that are assigned a landing car call for a rear car with respect to its traveling direction, the up landing call 112B of the 7th floor for the car 1B is detected. Since the detected up landing call 112B and the destination floor call 150 are for the same upward traveling direction, and the destination floor of the destination floor call 150 and the floor of the up landing call 112B are the same 7th floor, the front car 1A that is in the same hoistway as the car 1B is excluded from assignment candidate cars by a front-car assignment-candidate exclusion means. The elevator group-control device selects an assignment car from other cars excluding the car 1A, dispatches the assignment car for the new destination floor call 150 of the 5th floor for the 7th floor, and displays the assigned car number in a liquid-crystal display part of an operational panel for registering a destination floor at a hall.

Figure 4:
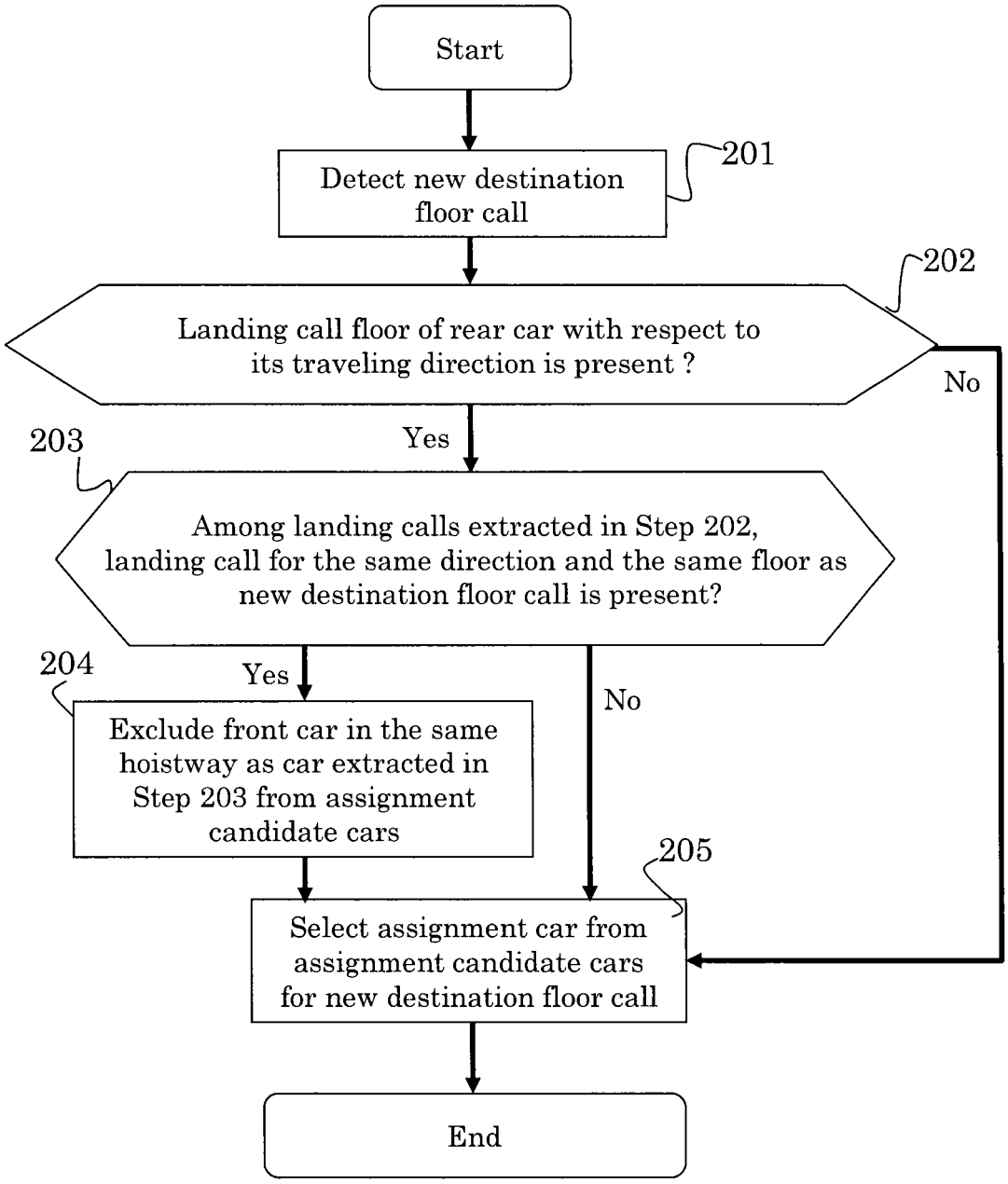
FIG. 4 is a flow chart showing an operational flow of the elevator group-control device according to Embodiment 2 of the invention.

Next, an assigned car selecting method for the elevator group-control device according to Embodiment 2 of the invention will be explained using the flow chart of FIG. 4. First, in Step 201, a new destination floor call is detected. Next, in Step 202, a landing call floor for a rear car with respect to its traveling direction is extracted. In this step, an upper car and a lower car in the same hoistway are separately extracted. Next, among the landing calls extracted in Step 202, it is determined in Step 203 whether or not there exists a landing call that coincides with the new destination floor call in terms of the traveling direction and the destination floor. If it is determined in Step 203 that there exists an applicable car, the front car in the same hoistway as the applicable car is excluded from assignment candidate cars in Step 204, and Step 205 is performed. If it is determined in Step 203 that there exists no applicable car, Step 205 is performed. In Step 205, an appropriate assignment car is selected among assignment candidate cars so as to reduce the waiting time at each hall and the number of stops of each car.

Figure 7:
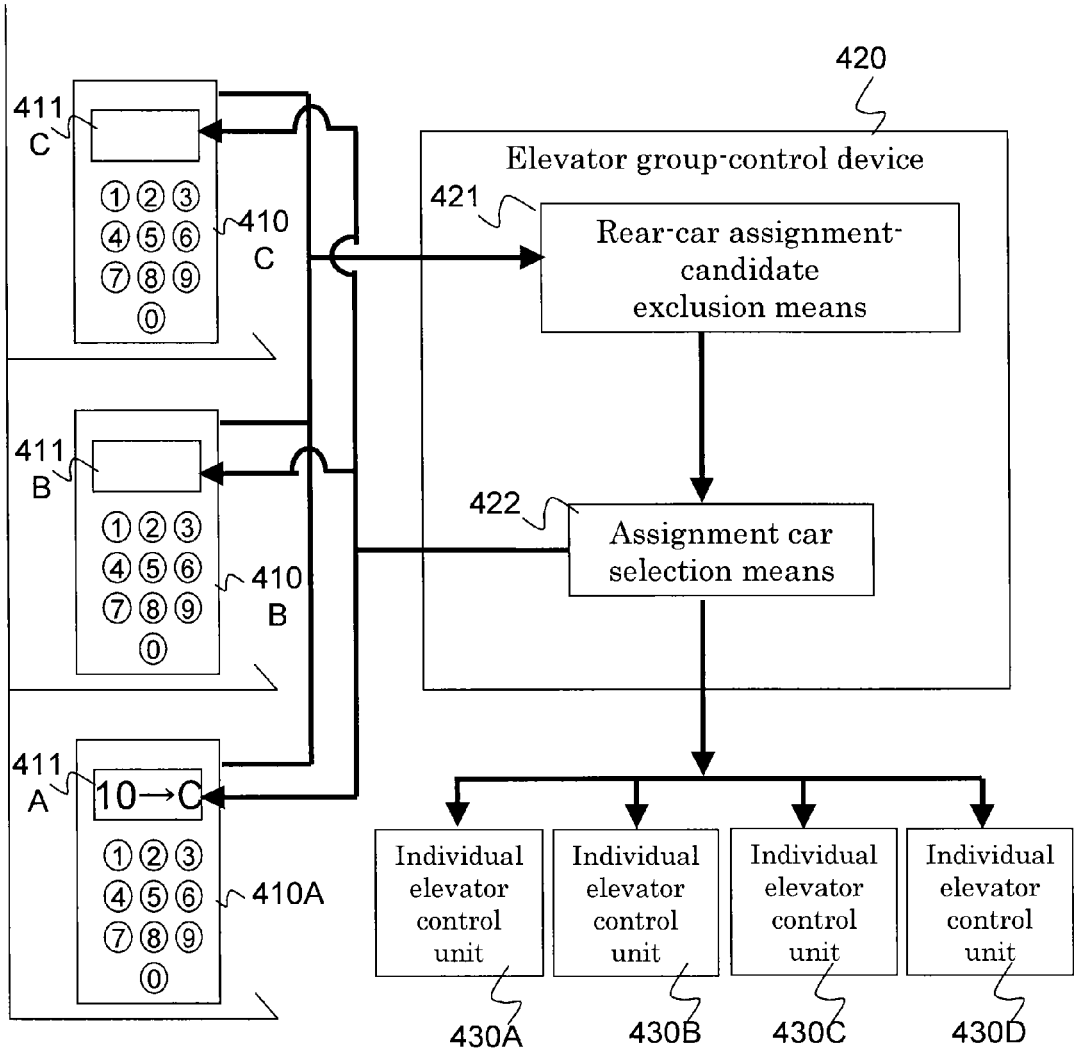
FIG. 7 is a diagram showing a system configuration of the elevator group-control device according to Embodiment 1 of the invention.

The system configuration is the same as that of Embodiment 1, except that the rear-car assignment-candidate exclusion means in FIG. 7 is replaced with the front-car assignment-candidate exclusion means.

It should be noted that, although the explanation has been made for an elevator group-control device for controlling a one-shaft multi-car elevator in which a plurality of cars are operated independently in the same hoistway, the elevator group-control device may be for controlling a double-deck elevator system in which a plurality of cars are operated in a coupled manner.

The elevator group-control device thus configured eliminates arrival of the other car in the same hoistway in response to a landing call for the same floor and the same direction as the car after first arrival of the car in response to a car call. This brings about an effect of preventing a passenger from erroneously boarding the car arriving in response to the car call and further brings about an effect of eliminating installation of a unit such as a display for informing a passenger of whether a currently arriving car is the upper car or the lower car to help a passenger avoid erroneously boarding the car.

Embodiment 3

Figure 5:
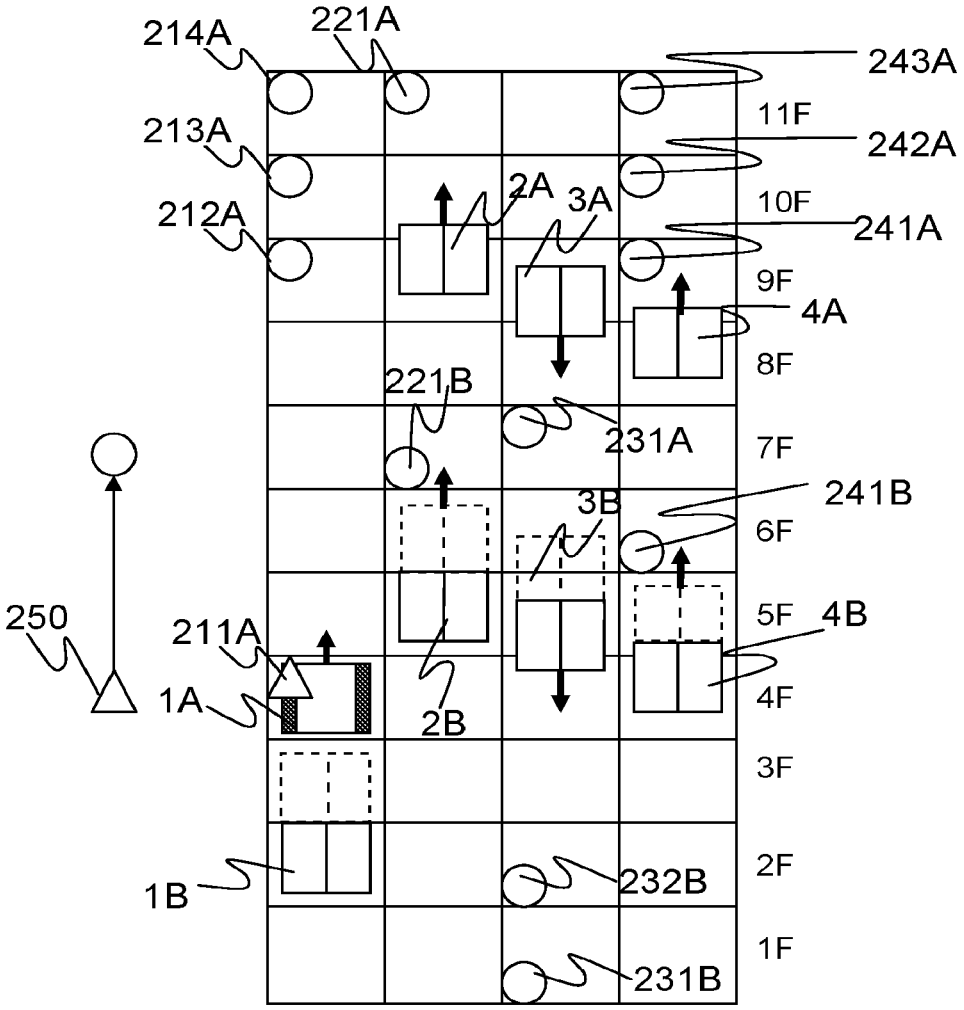
FIG. 5 is a diagram showing a call status of an elevator group-control device according to Embodiment 3 of the invention.

FIG. 5 is a diagram showing landing calls, car calls, and positions of cars registered by an elevator group-control device according to Embodiment 3 of the invention. FIG. 5 shows a one-shaft multi-car elevator system in which a plurality of cars are operated independently in the same hoistway. A pair of cars 1A and 1B, 2A and 2B, 3A and 3B, and 4A and 4B are operated in respective same hoistways. The upper car 1A is responding to an up landing call 211A at the 4th floor with its door being fully opened, and is stopping at the 9th floor in response to a car call 212A, at the 10th floor in response to a car call 213A, and at the 11th floor in response to a car call 214A. The lower car 1B is on standby at the 2nd floor with its door being closed. The car 2A travels upwardly and is stopping at the 11th floor in response to a car call 221A, and the car 2B travels upwardly and is stopping at the 7th floor in response to a car call 221B. The car 3A travels downwardly and is stopping at the 7th floor in response to a car call 231A. The car 3B travels downwardly and is stopping at the 1st floor in response to a car call 231B and at the 2nd floor in response to a car call 232B. And the car 4A travels upwardly and is stopping at the 9th floor in response to a car call 241A, at the 10th floor in response to a car call 242A, and at the 11th floor in response to a car call 243A. The car 4B travels upwardly and is stopping at the 6th floor for a car call 241B.

Here, an operational flow will be explained assuming a case where a destination floor call 250 of the 4th floor for the 7th floor is newly registered. Using a front-car car-call detection means for detecting a floor and a car that are assigned a landing car call for a front car with respect to its traveling direction, the landing call of the 4th floor for the car 1A is detected. Since the detected landing call of the 4th floor for the car 1A is the same as the new destination floor call 250 in terms of the landing call floor and the traveling direction, and the car 1A is responding to the landing call with its door being fully opened, i.e., not in closing operation or not completely closed, the car 1B in the same hoistway as the car 1A is excluded from assignment candidate cars by a same-floor and upper/lower car assignment-candidate means. The elevator group-control device selects an assignment car from other cars excluding the car 1B, dispatches an assignment car for the new destination floor call 250 of the 4th floor for 7th floor, and displays the assigned car number in a liquid-crystal display part of an operational panel for registering a destination floor at a hall.

Although the car 1A has been already assigned a large number of car calls, and the cars 2A, 2B, 3A, 3B, 4A, and 4B need time to respond to the new destination floor call 250, the elevator group-control device selects an assignment car from the cars excluding the car 1B.

Figure 6:
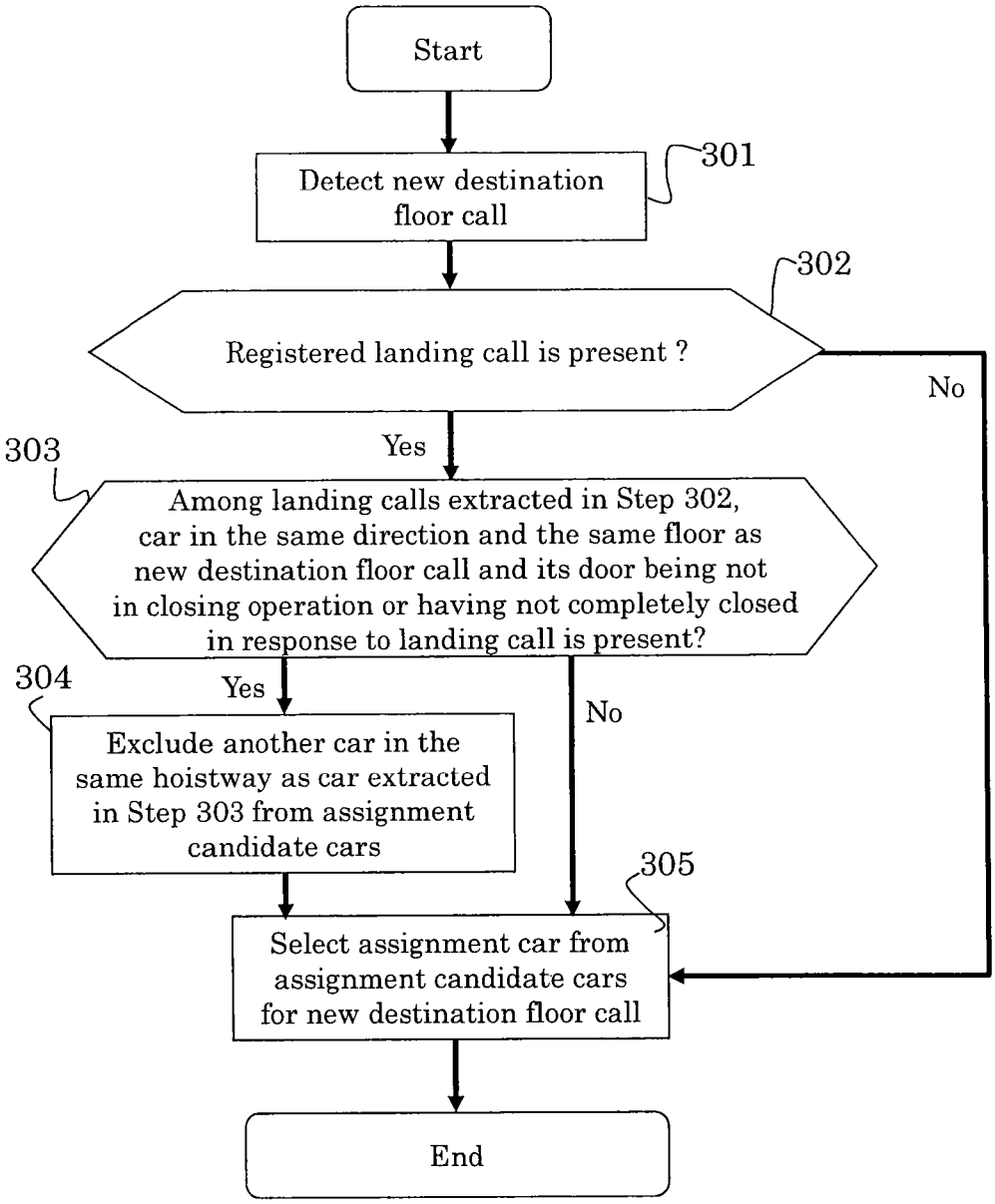
FIG. 6 is a flow chart showing an operational flow of the elevator group-control device according to Embodiment 3 of the invention.

Next, an assigned car selecting method for the elevator group-control device according to Embodiment 3 of the invention will be explained using the flow chart of FIG. 6. First, in Step 301, a new destination floor call is detected. Next, in Step 302, registered landing call floors are extracted. In this step, an upper car and a lower car in the same hoistway are separately extracted. Next, among the landing calls extracted in Step 302, it is determined in Step 303 whether or not there exists a landing call that coincides with the new landing call in terms of the traveling direction and the floor, and exists a car whose door is not in closing operation or has not been completely closed in response to the landing call. If it is determined in Step 303 that there exists an applicable car, the other car in the same hoistway as the car is excluded from assignment candidate cars in Step 304, and Step 305 is performed. If it is determined in Step 303 that there exists no applicable car, Step 305 is performed. In Step 305, an appropriate assignment car is selected among assignment candidate cars so as to reduce the waiting time at each hall and the number of stops of each car.

The system configuration is the same as that of Embodiment 1, except that the rear-car assignment-candidate exclusion means in FIG. 7 is replaced with the same-floor and upper/lower car assignment-candidate means.

It should be noted that, although the explanation has been made for an elevator group-control device for controlling a one-shaft multi-car elevator system in which a plurality of cars are operated independently in the same hoistway, the elevator group-control device may be for controlling a double-deck elevator system in which a plurality of cars are operated in a coupled manner.

In the elevator group-control device thus configured, the other car in the same hoistway as a car responding to a landing call will not be assigned to the landing call for the same floor and the same direction. This brings about an effect of preventing a passenger from erroneously boarding the car arriving in response to the car call and further brings about an effect of eliminating installation of a unit such as a display for informing a passenger whether a currently arriving car is the upper car or the lower car to help a passenger avoid erroneously boarding the car.

INDUSTRIAL APPLICABILITY

The present invention can be effectively utilized in appropriately determining an assignment car in an elevator group-control device for controlling a plurality of cars in a double-deck elevator system in which a plurality of cars are operated in a coupled manner in a single hoistway, and in a one-shaft multi-car system in which a plurality of cars are operated independently in a single hoistway.

EXPLANATION OF REFERENCE NUMERALS

1A-4B car
11A-31A landing call and car call
50 new destination floor call
111A-131A landing call and car call
150 new destination floor call
211A-243A landing call and car call
250 new destination floor call
410A-410C hall operational panel
411A-411C liquid-crystal part of hall operational panel
420 elevator group-control device
421 front-car assignment-candidate exclusion means
422 assignment car selection means
430A-430D individual elevator control unit

The invention claimed is:

1. An elevator group-control device in an elevator system in which a plurality of cars are operated in a coupled or independent manner in a single hoistway and in which a destination can be registered by inputting the destination at a hall, the elevator group-control device comprising:

a front-car car-call detector that detects a registered floor, with respect to a traveling direction of a front car out of the plurality of cars, to which a car call is registered or to which the front car is registered by the inputting of the destination at the hall; and a rear-car assignment-candidate exclusion circuitry configured to exclude a rear car, which is in the same hoistway as the front car, from assignment candidate cars, if a landing call having the same direction as the traveling direction of the front car is registered from the registered floor detected by the front-car car-call detector.

2. An elevator group-control device in an elevator system in which a plurality of cars are operated in a coupled or an independent manner in a single hoistway, the elevator group-control device comprising:

a landing destination-floor registration circuitry configured to register a destination floor call for a destination floor being input at a hall;

a rear-car landing-call detector that detects the registered destination floor call, with respect to a traveling direction of a rear car out of the plurality of cars, to which a landing call is registered or to which the rear car is registered by the inputting of the destination floor at the hall; and a front-car assignment-candidate exclusion circuitry configured to exclude a front car, which is in the same hoistway as the rear car, from assignment candidate cars, if the destination floor call having the same destination floor as the landing call and having the same direction as the traveling direction of the rear car is registered from the registered destination floor call detected by the rear-car landing-call detector.

3. An elevator group-control device in an elevator system in which a plurality of cars are operated in a coupled manner or independent manner in a single hoistway and in which a destination can be registered by inputting the destination at a hall, the elevator group-control device comprising:

a landing call detector that detects, out of the plurality of cars, a floor and a car that are assigned a landing call; and a same-floor and upper/lower car assignment-candidate exclusion circuitry configured to exclude, from assignment candidate cars, the other car in the same hoistway for a new landing call for the same floor and the same direction as the landing call, until a door of the landing call assigned car is in closing operation or is completely closed in response to the landing call at a floor registered by the landing call detected by the landing call detector.

* * * * *